US006463756B1

(12) United States Patent
Lewis

(10) Patent No.: US 6,463,756 B1
(45) Date of Patent: Oct. 15, 2002

(54) COMBINED ICE CHEST AND PERSONAL COOLING APPARATUS

(76) Inventor: Robert A. Lewis, 5707 E. Floral Ave., Selma, CA (US) 93662

( * ) Notice: Subject to any disclaimer, the term of this patent is extended or adjusted under 35 U.S.C. 154(b) by 0 days.

(21) Appl. No.: 10/126,887

(22) Filed: Apr. 19, 2002

(51) Int. Cl.[7] ..... F25D 3/08

(52) U.S. Cl. ..... 62/457.7; 62/457.2; 62/457.5; 62/371; 62/529

(58) Field of Search ..... 62/457.2, 457.7, 62/457.5, 371, 529

(56) References Cited

U.S. PATENT DOCUMENTS

| | | | | | |
|---|---|---|---|---|---|
| 1,640,252 | A | | 8/1927 | Rizer | |
| 4,249,392 | A | * | 2/1981 | Hotta | 62/457 |
| 4,615,137 | A | * | 10/1986 | Radmanovich | 43/57 |
| 5,090,214 | A | | 2/1992 | Logioco | |
| 5,285,657 | A | * | 2/1994 | Bacchi et al. | 62/457.9 |
| 5,373,703 | A | * | 12/1994 | Pal | 62/91 |
| 5,398,520 | A | | 3/1995 | Kamin et al. | |
| 5,685,165 | A | * | 11/1997 | Bigelow, Jr. | 62/420 |
| 5,737,938 | A | * | 4/1998 | Liu | 62/425 |
| 5,870,897 | A | | 2/1999 | Barr et al. | |
| 5,967,225 | A | * | 10/1999 | Jenkins | 165/46 |
| D429,606 | S | | 8/2000 | Israel et al. | |
| 6,116,043 | A | | 9/2000 | Clark et al. | |
| 6,336,341 | B1 | * | 1/2002 | McGraw et al. | 62/420 |
| 6,401,483 | B1 | * | 6/2002 | Kopp | 62/420 |

* cited by examiner

*Primary Examiner*—William Doerrler
*Assistant Examiner*—Mark S. Shulman

(57) ABSTRACT

A combined ice chest and personal cooling apparatus for keeping items cold and providing a user with a way by which to apply cool water onto themself. The combined ice chest and personal cooling apparatus includes a housing that has a bottom wall and a peripheral wall attached to and that extends upward from the bottom wall. The housing has a first end and second end. The housing has a first compartment, a second compartment, and a bottom compartment. A first cover and a second cover selectively cover the first and second compartments respectively. A strap for allows the user to grasp the housing. A pair of wheels are rotatably coupled to the housing. A filter restricts debris from entering the bottom compartment. A pump pressurizes the bottom compartment. A check-valve extends into the bottom compartment. A flexible tube has a first end and a second end. A plurality of dispersing members for dispersing water from the bottom compartment is releasably attachable to the second end of the tube.

20 Claims, 4 Drawing Sheets

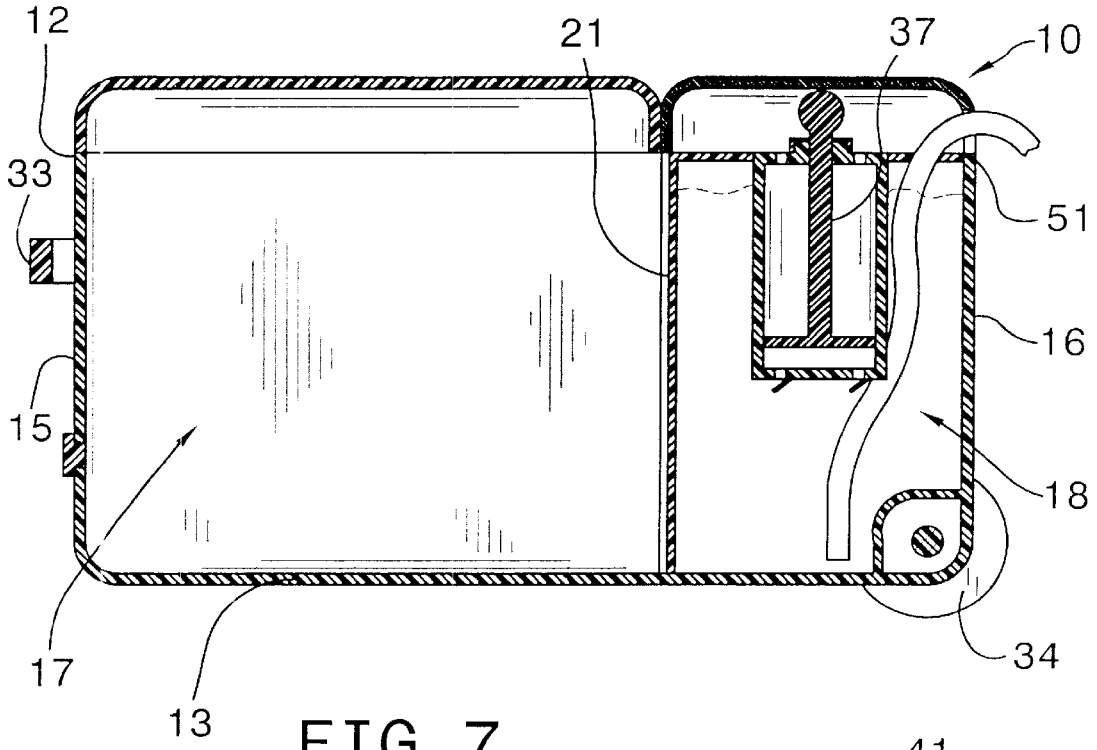
FIG.7
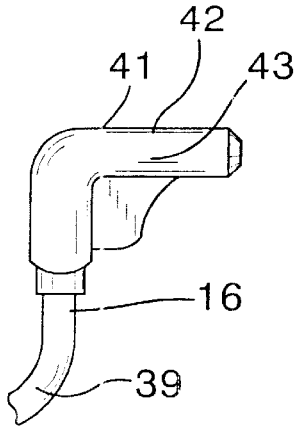
FIG.4
FIG.5
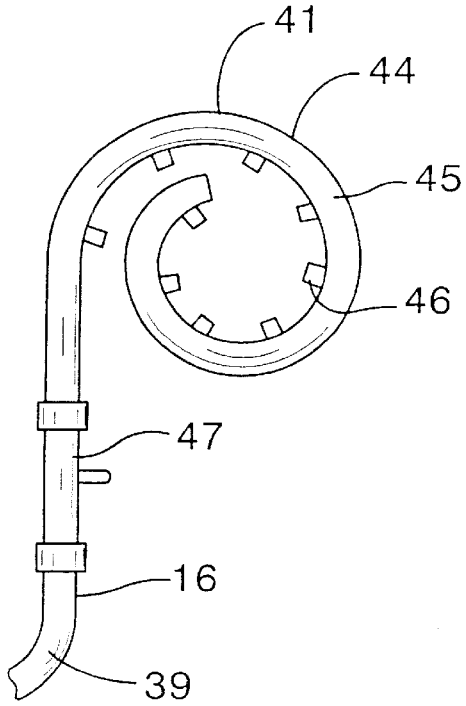

COMBINED ICE CHEST AND PERSONAL COOLING APPARATUS

BACKGROUND OF THE INVENTION

1. Field of the Invention

The present invention relates to coolers and more particularly pertains to a new combined ice chest and personal cooling apparatus for keeping items cold and providing users with a way by which to apply cool water onto themselves.

2. Description of the Prior Art

The use of coolers is known in the prior art. U.S. Pat. No. 5,090,214 describes a spray mate cooler. Another type of cooler is U.S. Pat. No. 5,870,897 which is a refrigerated container.

While these devices fulfill their respective, particular objectives and requirements, the need remains for a device works as an ice chest yet utilizes melted water from the ice to be selectively applied to a person for the purpose of cooling off.

SUMMARY OF THE INVENTION

The present invention meets the needs presented above by the construction of the housing in such a manner that if the user desires to allow the melted water from the ice to enter a compartment from which water to be used for personal cooling purposes, selectively is able to do so.

Still yet another object of the present invention is to provide a new combined ice chest and personal cooling apparatus that provides a variety of ways in which to apply the cooling water.

Even still another object of the present invention is to provide a new combined ice chest and personal cooling apparatus that provides a secondary embodiment by which the ice chest is completely separate from the compartment holding the cooling water, making for a more simplistic design.

To this end, the present invention generally comprises a housing that has a bottom wall and a peripheral wall attached to and that extends upward from the bottom wall. The housing has a first end and second end. The housing has a first compartment, a second compartment, and a bottom compartment. A first cover and a second cover selectively cover the first and second compartments respectively. A strap allows the user to grasp the housing. A pair of wheels are rotatably coupled to the housing. A filter restricts debris from entering the bottom compartment. A pump pressurizes the bottom compartment. A check-valve extends into the bottom compartment. A flexible tube has a first end and a second end. A plurality of dispersing members for dispersing water from the bottom compartment is releasably attachable to the second end of the tube.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a schematic side view of the spray device of the present invention.

FIG. 5 is a schematic side view of the tubular dispensing member of the present invention.

FIG. 7 is a schematic cross-sectional side view of the secondary embodiment of the present invention.

DESCRIPTION OF THE PREFERRED EMBODIMENT

Figure 1:
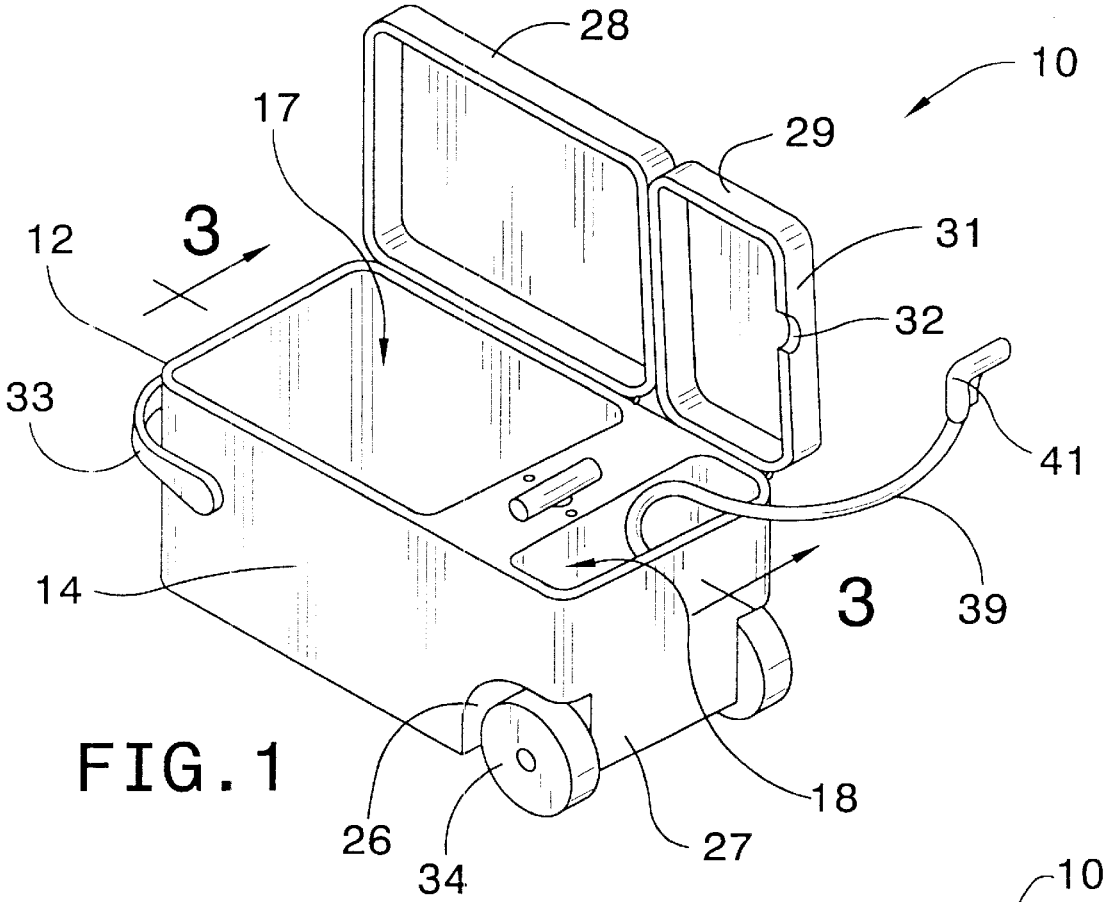
FIG. 1 is a schematic perspective view of a new combined ice chest and personal cooling apparatus according to the present invention.
Figure 2:
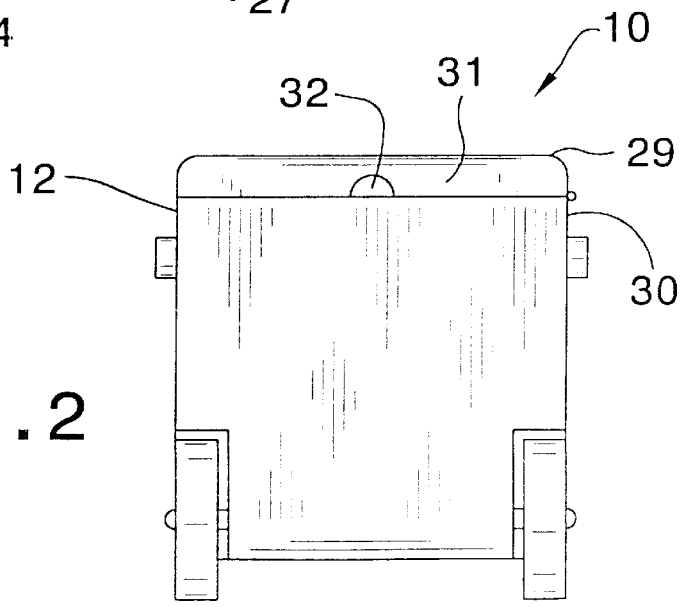
FIG. 2 is a schematic an end view of the present invention.
Figure 3:
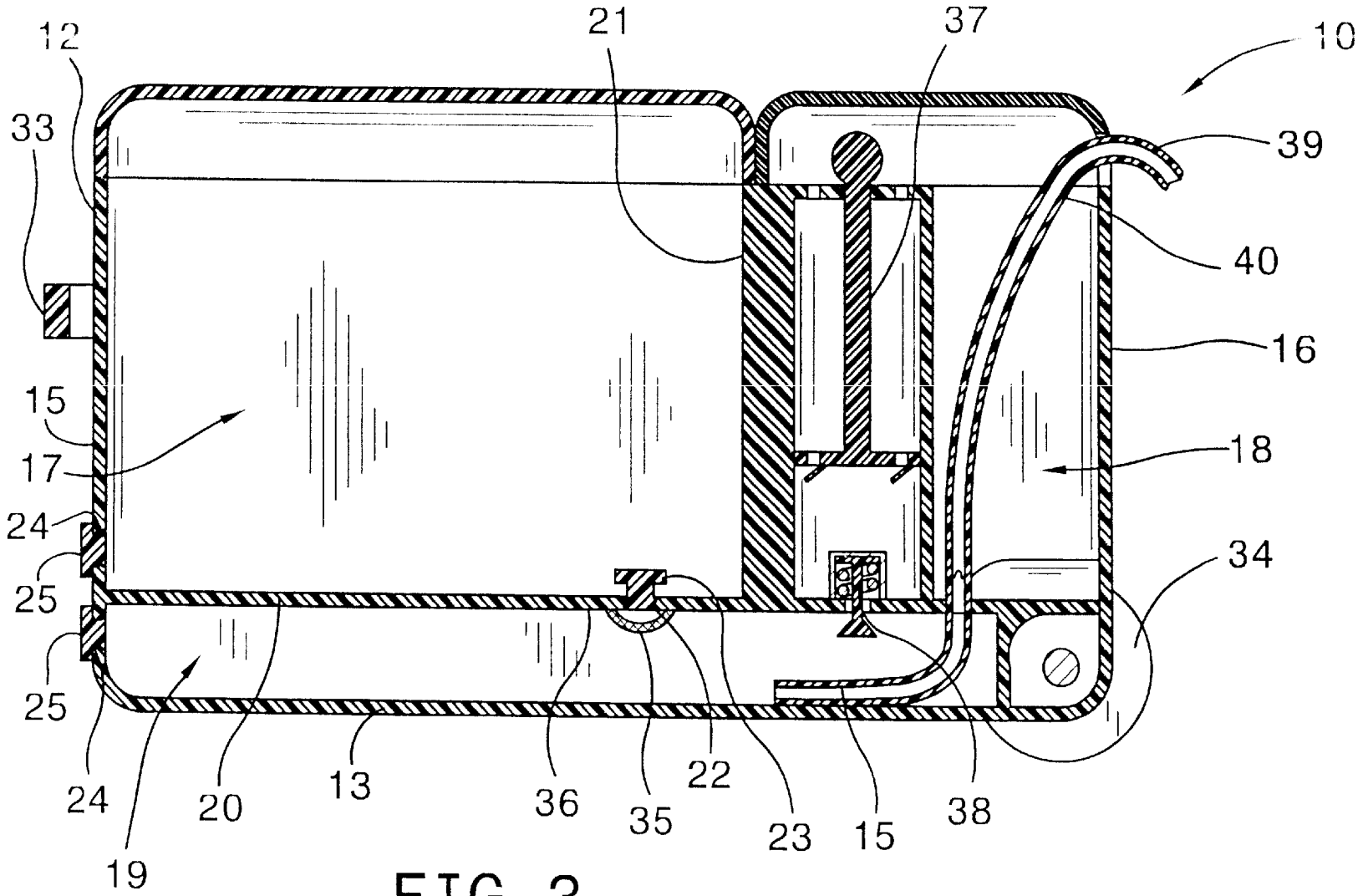
FIG. 3 is a schematic cross-sectional side view of the present invention.
Figure 6:
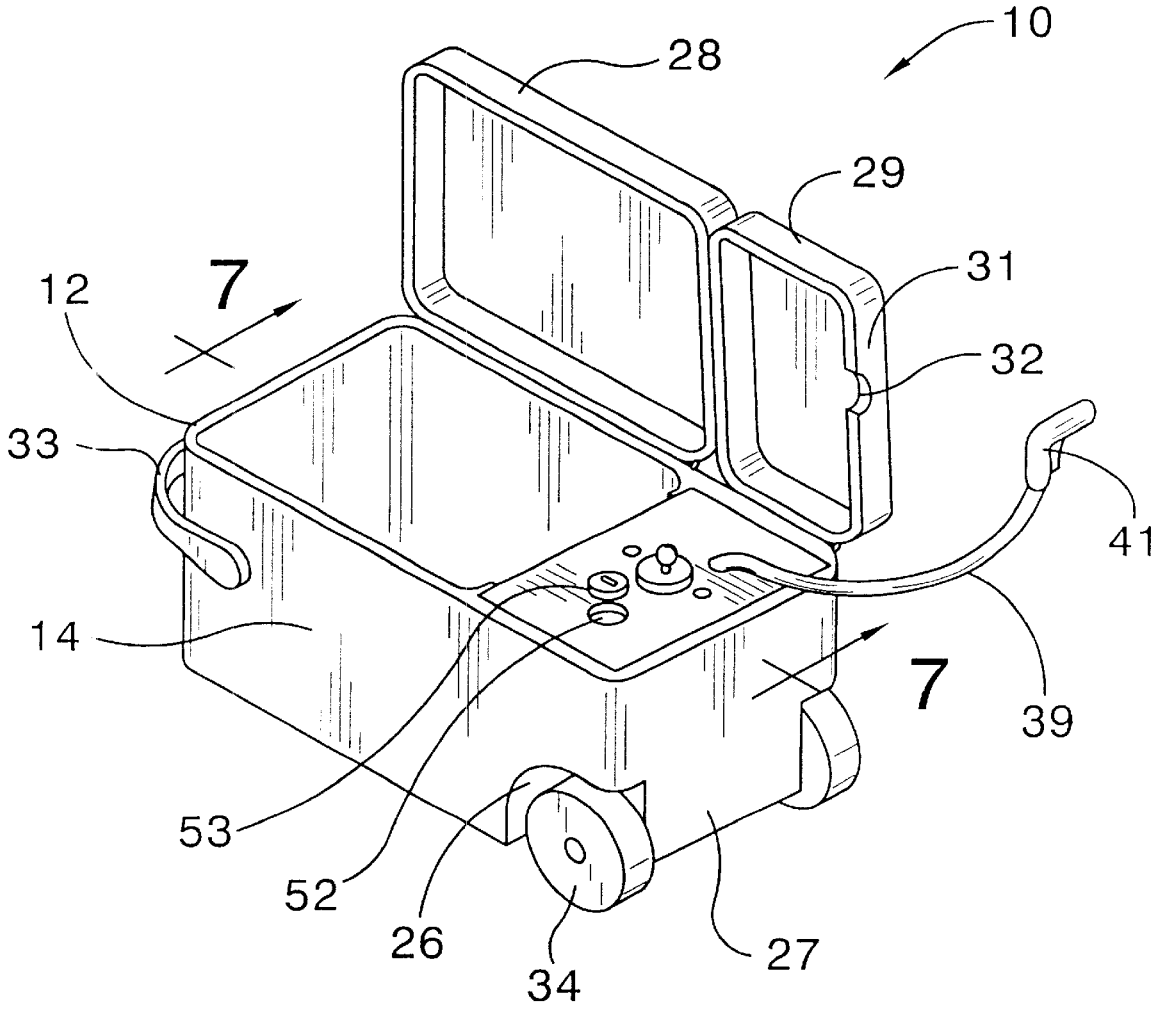
FIG. 6 is a schematic perspective view of the secondary embodiment of the present invention.

With reference now to the drawings, and in particular to FIGS. 1 through 7 thereof, a new combined ice chest and personal cooling apparatus embodying the principles and concepts of the present invention and generally designated by the reference numeral 10 will be described.

As best illustrated in FIGS. 1 through 7, the combined ice chest and personal cooling apparatus 10 generally comprises a housing 12 that has a bottom wall 13 and a peripheral wall 14 that is attached to and extends upward from the bottom wall 13. The housing 12 has a first end 15 and second end 16. The housing 12 has a first compartment 17, a second compartment 18, and a bottom compartment 19.

The housing 12 has a partition wall 20 that is attached to and extends between the peripheral wall 14 and is oriented substantially parallel to the bottom wall 13 and positioned generally above the bottom wall 13 such that the bottom compartment 19 is defined.

The housing 12 has a sectional wall 21 positioned therein. The sectional wall 21 is oriented substantially perpendicular to and extends upward from the partition wall 20 such that the first compartment 17 and the second compartment 18 are defined. The first compartment 17 and the second compartment 18 are positioned adjacent to the first and second ends 15, 16 of the housing 12 respectively.

The partition wall 20 has an aperture 22 that extends therethrough and is positioned in the first compartment 17 such that the first compartment 17 and the bottom compartment 19 are in fluid communication. The housing 12 includes a bottom plug 23 for selectively plugging the aperture 22 in the partition wall 20. The bottom plug 23 is selectively positionable in the aperture 22. Water from melted ice placed in the first compartment 17 enters the bottom compartment 19.

The first compartment 17 has a drain hole 24 that extends through the peripheral wall 14 and is positioned in the first end 15. The bottom compartment 19 has a drain hole 24 that extends through the peripheral wall 14 and is positioned in the first end 15. A pair of plugs 25 is included for selectively plugging the drain holes 24 in the first compartment 17 and the bottom compartment 19. Each of the plugs 25 is selectively positionable in one of the drain holes 24.

The housing 12 has a pair of arcuate indentations 26 positioned on opposing sides of a bottom portion 27 of the second end 16.

A first cover 28 and a second cover 29 selectively covers the first and second compartments 17, 18 respectively. Each of the covers 28, 29 is hingably coupled to an upper rear portion 30 of the peripheral wall 14. An end wall 31 of the second cover 29 has an arcuate cutout 32 therein.

A strap 33 for allowing the user to grasp the housing 12 is pivotally coupled to the first end 15.

A pair of wheels 34 is rotatably coupled to the housing 12. Each of the wheels 34 is positioned in one of the arcuate indentations 26 of the housing 12. Each of the wheels 34 extends away from the housing 12 such that the wheels 34 support the second end 16 of the housing 12.

A filter 35 for restricting debris from entering the bottom compartment 19 is fixedly coupled to a bottom surface 36 of the partition wall 20. The filter 35 is positioned over the aperture 22.

A pump 37 for pressurizing the bottom compartment 19 is integrally coupled to the housing 12 and positioned between the first compartment 17 and the second compartment 18.

A check-valve 38 extends into the bottom compartment 19. The check-valve 38 is fixedly coupled to and extends through the partition wall 20. The check-valve 38 is positioned below the pump 37 such that air from the pump 37 is allowed to enter the bottom compartment 19 and restricted from exiting the bottom compartment 19 such that the bottom compartment 19 becomes pressurized.

A flexible tube 39 has a first end 15 and a second end 16 is fixedly coupled to and extends through the partition wall 20 in the second compartment 18. The first end 15 of the tube 39 is positioned in the bottom compartment 19. A middle section 40 of the tube 39 extends outward from the second compartment 18 such that the tube 39 passes through the arcuate cutout 32 in the second cover 29 when the second cover 29 fully encloses the second compartment 18.

A plurality of dispersing members 41 for dispersing water from the bottom compartment 19 is releasably attachable to the second end 16 of the tube 39. A first one of the plurality of dispersing members 42 comprises a hand-held spray device 43 for selectively applying water.

A second one of the plurality of dispersing members 44 comprises an elongate tubular member 45 that has a plurality of nozzles 46. Each of the nozzles 46 is equally spaced apart such that the water may be widely dispersed. The tubular member 45 includes a valve section 47 for selectively turning the water on and off.

When water from the melted ice in the first compartment 17 enters the bottom compartment 19 and the pump 37 is actuated to pressurize the bottom compartment 19, actuation of the dispersing member allows the water to pass through the tube 39 and be dispersed.

In an alternate embodiment, the housing 12 has only the first and second compartments 17, 18 with the second compartment 18 having a top wall 50 that is integrally coupled to upper edges 51 of the peripheral wall 14. The user fills the second compartment 18 with chilled water through an opening 52 in the top wall 50, seals the opening 52 with a cap 53, and utilizes the pump 37, flexible tube 39, and a dispersing member 41 to use the water to cool off as desired. The first compartment 17 functions simply as an ice chest. All other aspects of the invention remain the same.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combined ice chest and personal cooling apparatus for keeping items cold and providing a user with a way by which to apply cool water onto themselves, said apparatus comprising:

a housing having a bottom wall and a peripheral wall attached to and extending upwardly from said bottom wall, said housing having a first end and second end, said housing having a first compartment, a second compartment, and a bottom compartment;

a first cover and a second cover for selectively covering said first and second compartments respectively;

a strap for allowing the user to grasp said housing;

a pair of wheels being rotatably coupled to said housing;

a filter for restricting debris from entering said bottom compartment;

a pump for pressurizing said bottom compartment;

a check-valve extending into said bottom compartment;

a flexible tube having a first end and a second end; and a plurality of dispersing members for dispersing water from. said bottom compartment being releasably attachable to said second end of said tube.

2. The combined ice chest and personal cooling apparatus as set forth in claim 1, further comprising said housing having a partition wall being attached to and extending between said peripheral wall, said partition wall being oriented substantially parallel to said bottom wall and positioned generally above said bottom wall such that said bottom compartment is defined.

3. The combined ice chest and personal cooling apparatus as set forth in claim 2, further comprising said housing having a sectional wall positioned therein, said sectional wall being oriented substantially perpendicular to and extending upwardly from said partition wall such that said first compartment and said second compartment are defined, wherein said first compartment and said second compartment are positioned adjacent to said first and second ends of said housing respectively.

4. The combined ice chest and personal cooling apparatus as set forth in claim 2, further comprising said partition wall having an aperture extending therethrough and positioned in said first compartment such that said first compartment and said bottom compartment are in fluid communication, said housing including a bottom plug for selectively plugging said aperture in said partition wall, said bottom plug being selectively positionable in said aperture, wherein water from melting ice placed in said first compartment may enter said bottom compartment.

5. The combined ice chest and personal cooling apparatus as set forth in claim 1, further comprising said first compartment having a drain hole extending through said peripheral wall and positioned in said first end, said bottom compartment having a drain hole extending through said peripheral wall and positioned in said first end.

6. The combined ice chest and personal cooling apparatus as set forth in claim 5, further comprising a pair of plugs for selectively plugging said drain holes in said first compartment and said bottom compartment, each of said plugs being selectively positionable in one of said drain holes.

7. The combined ice chest and personal cooling apparatus as set forth in claim 1, further comprising said housing having a pair of arcuate indentations positioned on opposing sides of a bottom portion of said second end.

8. The combined ice chest and personal cooling apparatus as set forth in claim 1, further comprising each of said covers being hingably coupled to an upper rear portion of said peripheral wall.

9. The combined ice chest and personal cooling apparatus as set forth in claim 1, further comprising an end wall of said second cover having an arcuate cutout therein.

10. The combined ice chest and personal cooling apparatus as set forth in claim 1, further comprising said straps being pivotally coupled to said first end of said housing.

11. The combined ice chest and personal cooling apparatus as set forth in claim 7, further comprising each of said wheels being positioned in one of said arcuate indentations of said housing, each of said wheels extending away from said housing such that said second end of said housing is supported by said wheels.

12. The combined ice chest and personal cooling apparatus as set forth in claim 4, further comprising said filter being fixedly coupled to a bottom surface of said partition wall, said filter being positioned over said aperture.

13. The combined ice chest and personal cooling apparatus as set forth in claim 1, further comprising said pump being integrally coupled to said housing and positioned between said first compartment and said second compartment.

14. The combined ice chest and personal cooling apparatus as set forth in claim 2, further comprising said check-valve being fixedly coupled to and extending through said partition wall, said check-valve being positioned below said pump such that air from said pump is allowed to enter said bottom compartment and restricted from exiting said bottom compartment such that said bottom compartment becomes pressurized.

15. The combined ice chest and personal cooling apparatus as set forth in claim 9, further comprising said tube being fixedly coupled to and extending through said partition wall in said second compartment, said first end of said tube being positioned in said bottom compartment, a middle section of said tube extending outwardly from said second compartment such that said tube passes through said arcuate cutout in said second cover when said second cover fully encloses said second compartment.

16. The combined ice chest and personal cooling apparatus as set forth in claim 1, wherein a first of said plurality of dispersing members comprising a hand-held spray device for selectively applying water.

17. The combined ice chest and personal cooling apparatus as set forth in claim 1, further comprising wherein a second one of said plurality of dispersing members comprising an elongate tubular member has a plurality of nozzles, each of said nozzles being equally spaced apart such that the water may be widely dispersed, said tubular member including a valve section for selectively turning the water on and off.

18. The combined ice chest and personal cooling apparatus as set forth in claim 1, wherein when water from the melted ice in said first compartment may enter said bottom compartment and said pump may be actuated to pressurize said bottom compartment, actuation of said dispersing member allows the water to pass through said tube and be dispersed.

19. A combined ice chest and personal cooling apparatus for keeping items cold and providing a user with a way by which to apply cool water onto themselves, said apparatus comprising:

a housing having a bottom wall and a peripheral wall attached to and extending upwardly from said bottom wall, said bottom wall being generally rectangular, said housing having a first end and second end, said housing having a sectional wall positioned therein such that a first compartment and a second compartment are defined, wherein said first compartment and said second compartment are positioned adjacent to said first and second ends of said housing respectively, said second compartment having a top wall attached to and extending between upper edges of said peripheral wall, said top wall having an opening extending therethrough for filling said second compartment with water, said first compartment having a drain hole extending through said peripheral wall and positioned in said first end, said housing having a pair of arcuate indentations positioned on opposing sides of a bottom portion of said second end;

a cap for selectively enclosing said second compartment being releasably positionable in said opening of said top wall of said second compartment;

a first cover and a second cover for selectively covering said first and second compartments respectively, each of said covers being hingably coupled to an upper rear portion of said peripheral wall, an end wall of said second cover having an arcuate cutout therein;

a strap for allowing the user to grasp said housing being pivotally coupled to said first end;

a pair of wheels being rotatably coupled to said housing, each of said wheels being positioned in one of said arcuate indentations of said housing, each of said wheels extending away from said housing such that said second end of said housing is supported by said wheels;

a plug for selectively plugging said drain hole in said first compartment being selectively positionable in said drain hole;

a pump for pressurizing said second compartment being integrally coupled to said top wall and positioned in said second compartment;

a flexible tube having a first end and a second end being fixedly coupled to and extending through said top wall of said second compartment, said first end of said tube being positioned adjacent to a top surface of bottom wall in said second compartment, a middle section of said tube extending outwardly from said second compartment such that said tube passes through said arcuate cutout in said second cover when said second cover fully encloses said second compartment;

a plurality of dispersing members for dispersing water from said bottom compartment being releasably attachable to said second end of said tube, wherein a first of said plurality of dispersing members comprising a hand-held spray device for selectively applying water, wherein a second one of said plurality of dispersing members comprising an elongate tubular member has a plurality of nozzles, each of said nozzles being equally spaced apart such that the water may be widely dispersed, said tubular member including a valve section for selectively turning the water on and off; and wherein said pump may be actuated to pressurize said second compartment such that actuation of said dispersing member allows the water to pass through said tube and be dispersed.

20. A combined ice chest and personal cooling apparatus for keeping items cold and providing a user with a way by which to apply cool water onto themselves, said apparatus comprising:

a housing having a bottom wall and a peripheral wall attached to and extending upwardly from said bottom wall, said housing having a first end and second end, said housing having a first compartment, a second compartment, and a bottom compartment, said housing having a partition wall being attached to and extending between said peripheral wall, said partition wall being oriented substantially parallel to said bottom wall and positioned generally above said bottom wall such that said bottom compartment is defined, said housing having a sectional wall positioned therein, said sectional wall being oriented substantially perpendicular to and extending upwardly from said partition wall such that said first compartment and said second. compartment are defined, wherein said first compartment and said second compartment are positioned adjacent to said first and second ends of said housing respectively, said partition wall having an aperture extending therethrough and positioned in said first compartment such that said first compartment and said bottom compartment are in fluid communication, said housing including a bottom plug for selectively plugging said aperture in said partition wall, said bottom plug being selectively positionable in said aperture, wherein water from melting ice placed in said first compartment may enter said bottom compartment, said first compartment having a drain hole extending through said peripheral wall and positioned in said first end, said bottom compartment having a drain hole extending through said peripheral wall and positioned in said first end, a pair of plugs for selectively plugging said drain holes in said first compartment and said bottom compartment, each of said plugs being selectively positionable in one of said drain holes, said housing having a pair of arcuate indentations positioned on opposing sides of a bottom portion of said second end;

a first cover and a second cover for selectively covering said first and second compartments respectively, each of said covers being hingably coupled to an upper rear portion of said peripheral wall, an end wall of said second cover having an arcuate cutout therein;

a strap for allowing the user to grasp said housing being pivotally coupled to said first end;

a pair of wheels being rotatably coupled to said housing, each of said wheels being positioned in one of said arcuate indentations of said housing, each of said wheels extending away from said housing such that said second end of said housing is supported by said wheels;

a filter for restricting debris from entering said bottom compartment being fixedly coupled to a bottom surface of said partition wall, said filter being positioned over said aperture;

a pump for pressurizing said bottom compartment being integrally coupled to said housing and positioned between said first compartment and said second compartment;

a check-valve extending into said bottom compartment, said check-valve being fixedly coupled to and extending through said partition wall, said check-valve being positioned below said pump such that air from said pump is allowed to enter said bottom compartment and restricted from exiting said bottom compartment such that said bottom compartment becomes pressurized;

a flexible tube having a first end and a second end being fixedly coupled to and extending through said partition wall in said second compartment, said first end of said tube being positioned in said bottom compartment, a middle section of said tube extending outwardly from said second compartment such that said tube passes through said arcuate cutout in said second cover when said second cover fully encloses said second compartment;

a plurality of dispersing members for dispersing water from said bottom compartment being releasably attachable to said second end of said tube, wherein a first of said plurality of dispersing members comprising a hand-held spray device for selectively applying water, wherein a second one of said plurality of dispersing members comprising an elongate tubular member has a plurality of nozzles, each of said nozzles being equally spaced apart such that the water may be widely dispersed, said tubular member including a valve section for selectively turning the water on and off;

wherein when water from the melted ice in said first compartment may enter said bottom compartment and said pump may be actuated to pressurize said bottom compartment, actuation of said dispersing member allows the water to pass through said tube and be dispersed.

* * * * *